US008500412B2

(12) United States Patent
Williams et al.

(10) Patent No.: US 8,500,412 B2
(45) Date of Patent: Aug. 6, 2013

(54) ALARM SYSTEM FOR A SUMP PUMP ASSEMBLY

(75) Inventors: David M. Williams, Pavilion, NY (US); Jeffrey D. Goodenbery, North Chili, NY (US); Randall D Waldron, Rochester, NY (US)

(73) Assignee: Liberty Pumps, Inc., Bergen, NY (US)

( * ) Notice: Subject to any disclaimer, the term of this patent is extended or adjusted under 35 U.S.C. 154(b) by 540 days.

(21) Appl. No.: 12/576,214

(22) Filed: Oct. 8, 2009

(65) Prior Publication Data

US 2011/0085919 A1 Apr. 14, 2011

(51) Int. Cl.
*F04B 49/00* (2006.01)
*G08B 21/00* (2006.01)

(52) U.S. Cl.
USPC ..... 417/36; 340/620

(58) Field of Classification Search
USPC ..... 417/63, 36; 340/618–625
See application file for complete search history.

(56) References Cited

U.S. PATENT DOCUMENTS 3,553,575 A * 1/1971 Shea ..... 3/304 C
3,932,853 A * 1/1976 Cannon ..... 340/514
3,963,376 A * 6/1976 Miskin ..... 417/40
4,021,144 A * 5/1977 Matsusaka ..... 417/40
4,060,341 A * 11/1977 Tremain et al. ..... 417/182.5
4,084,073 A * 4/1978 Keener ..... 200/84 R
4,124,332 A * 11/1978 Nishijyo ..... 417/26
4,137,527 A * 1/1979 Tennenhouse et al. ..... 340/620
4,187,503 A * 2/1980 Walton ..... 340/624
4,222,711 A * 9/1980 Mayer ..... 417/7
4,228,427 A * 10/1980 Niedermeyer ..... 340/623
4,244,385 A * 1/1981 Hotine ..... 137/1
4,255,747 A * 3/1981 Bunia ..... 340/624
4,404,441 A * 9/1983 MacLaren ..... 200/84 C
4,422,829 A * 12/1983 Buchanan ..... 417/40
4,456,432 A * 6/1984 Mannino ..... 417/2
4,482,299 A * 11/1984 Eulass ..... 417/54
4,552,512 A * 11/1985 Gallup et al. ..... 417/6
4,841,282 A * 6/1989 Reis ..... 340/521
4,966,534 A * 10/1990 Hasslen, III ..... 417/423.3
5,055,000 A * 10/1991 Akhter ..... 417/40
5,302,088 A * 4/1994 Gronski et al. ..... 417/182.5
5,314,313 A * 5/1994 Janesky ..... 417/63
5,613,835 A * 3/1997 Tyner ..... 417/182.5
5,793,294 A * 8/1998 Schepka ..... 340/616
5,856,783 A * 1/1999 Gibb ..... 340/618
5,923,102 A * 7/1999 Koenig et al. ..... 307/118
6,050,779 A * 4/2000 Nagao et al. ..... 417/28
6,139,281 A * 10/2000 Schooler ..... 417/40
6,254,350 B1 * 7/2001 Koenig et al. ..... 417/36
6,267,901 B1 * 7/2001 Franklin ..... 210/800
6,364,620 B1 * 4/2002 Fletcher et al. ..... 417/36

(Continued)

*Primary Examiner* — Charles Freay
*Assistant Examiner* — Alexander Comley
(74) *Attorney, Agent, or Firm* — The Bilicki La Firm, P.C.; Rebecca Tapscott; Byron Bilicki

(57) ABSTRACT

An alarm system is provided for generating an alert when a water-powered sump pump is activated and water is being used by the water-powered sump pump. The alarm system includes a water sensor for detecting if water within a sump reaches the sensor and a housing for containing sensor electronics, wherein the water sensor is supported by the housing. In addition, a clamp is attached to the housing for releasably attaching the housing to a pipe such that the alarm system may be positioned to alert a user when water-powered sump pump is activated.

27 Claims, 9 Drawing Sheets

U.S. PATENT DOCUMENTS

| | | | | |
|---|---|---|---|---|
| 6,375,430 | B1 * | 4/2002 | Eckert et al. | 417/40 |
| 6,461,114 | B1 * | 10/2002 | Lin | 417/40 |
| 6,464,531 | B2 * | 10/2002 | Eckert et al. | 439/465 |
| 6,474,952 | B1 * | 11/2002 | Fisher et al. | 417/40 |
| 6,729,848 | B1 * | 5/2004 | Hasslen, III | 417/44.2 |
| 7,131,330 | B2 * | 11/2006 | Gurega | 73/306 |
| 7,264,449 | B1 * | 9/2007 | Harned et al. | 417/36 |
| 7,417,552 | B1 * | 8/2008 | Vaskovic | 340/616 |
| 7,429,842 | B2 * | 9/2008 | Schulman et al. | 318/482 |
| 7,471,207 | B1 * | 12/2008 | Chandler et al. | 340/618 |
| 2002/0034444 | A1 * | 3/2002 | Ostrowski | 417/40 |
| 2002/0047783 | A1 * | 4/2002 | Bergum et al. | 340/618 |
| 2005/0207902 | A1 * | 9/2005 | Bonifacio et al. | 417/182.5 |
| 2005/0281679 | A1 * | 12/2005 | Niedermeyer | 417/36 |
| 2008/0229819 | A1 * | 9/2008 | Mayleben et al. | 73/304 |

* cited by examiner

ALARM SYSTEM FOR A SUMP PUMP ASSEMBLY

DESCRIPTION OF THE EMBODIMENTS

Figure 1:
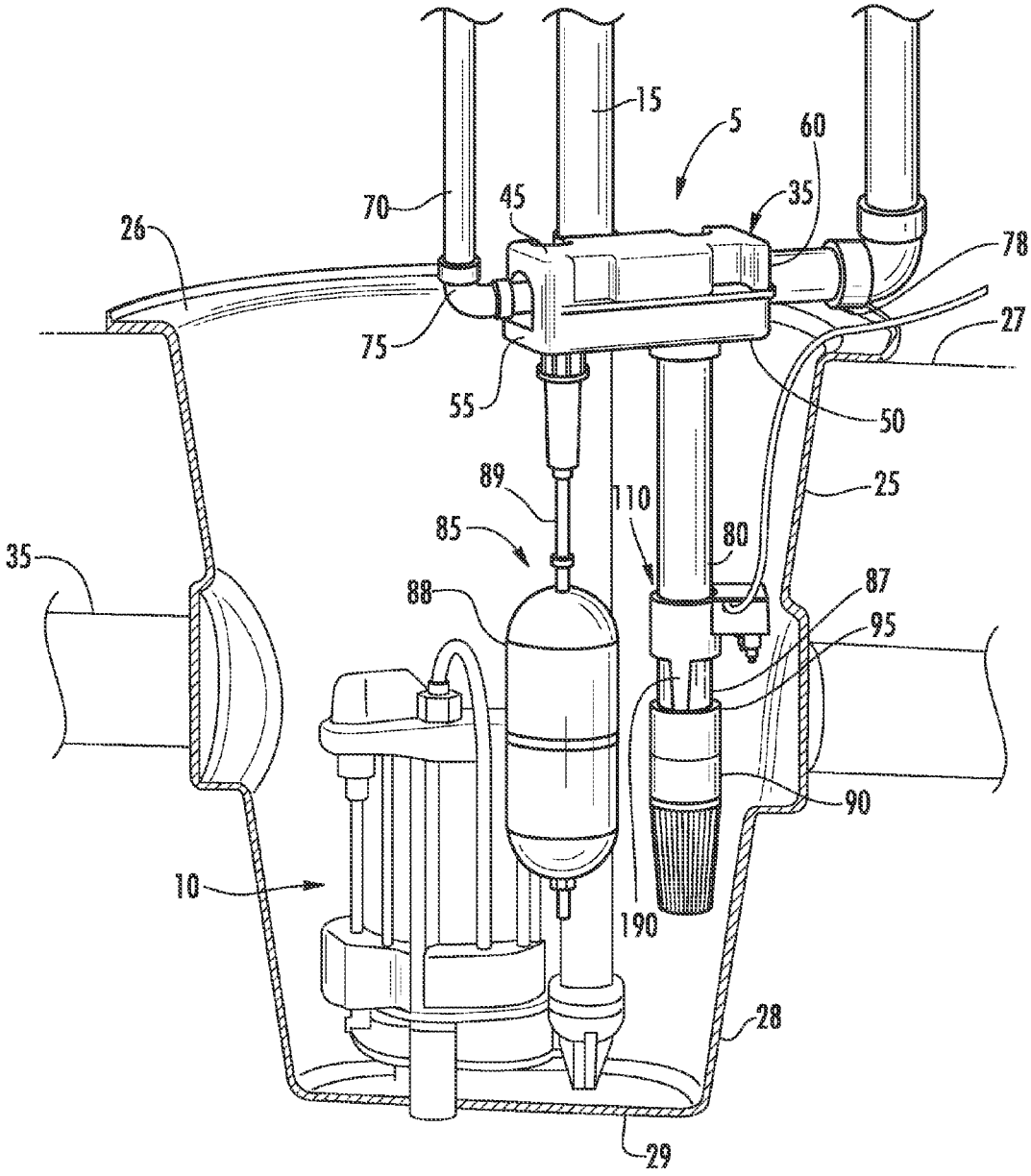
FIG. 1 is a cross sectional view of a sump basin containing a primary sump pump and a back-up sump pump with an alarm system.

As shown in FIG. 1, a water powered back-up sump pump assembly 5 is shown along with a primary sump pump 10. Back-up sump pump assembly 5 is mounted to a fixed discharge pipe 15 of primary sump pump 10 by suitable clamping or other attachment means (not shown). Primary sump pump 10 and back-up sump pump assembly 5 are positioned within sump basin 25. Water drains into sump basin 25 through a drain pipe 35. Sump basin 25 is positioned such that a top lip 26 sits upon a basement floor 27. As illustrated, sump basin 25 also includes a cylindrical sidewall 28 and bottom surface 29, which are positioned underground. Primary sump pump 10 is connected to discharge pipe 15 for discharging the liquid pumped by the primary sump pump 10 out of the sump basin 25 to a point external to the sump.

As shown in FIG. 1, back-up sump pump assembly 5 is a water powered back-up sump pump that protects against basement flooding in the case of a power outage, primary pump failure, or excessive inflow. Pump assembly 5 has a housing 35 which is mounted to discharge pipe 15 by conventional fasteners, such as hose clamps, so that housing 35 is above a top end 38 of sump basin 25. Alternatively, housing 35 may be mounted to a piece of wood (not shown) that is positioned across top end 38 of sump basin 25. Housing 35 includes a top 45, bottom 50, water inlet end 55 and water discharge end 60. Bottom end 50 of housing 35 should be approximately 12" above the water level at which primary sump pump 10 operates. Pump assembly 5 is powered by the municipal water supply and removes approximately 2 gallons of sump water per 1 gallon of municipal water used. Water enters inlet end 55 of housing 35 through inlet tube 70 at a pressure of between 30 and 100 psi. Inlet tube 70 is attached to housing 35 by a push-type pipe connector 75, such as SharkBite® by Cash Acme Co, and can be used with various ¾-inch potable water tubing and pipe, such as PEX tubing (ASTM F876, CSA B137.5), copper pipe (ASTM B 88), or CPVC pipe (ASTM D 2846, CSA B137.6). Water flows away from pump assembly 5 through secondary discharge tube 78, which is connected to water discharge end 60 of housing 35. In general, water powered back up sump pumps operate via the venturi effect. Thus, water flows into a venturi (not shown) of water-powered pump 5 where a restriction or narrowing at the neck of the venturi causes an increase in the water's velocity and a decrease in water pressure. This negative pressure creates a suction that draws water up from sump basin 25 into the venturi and out discharge tube 78.

Figure 2:
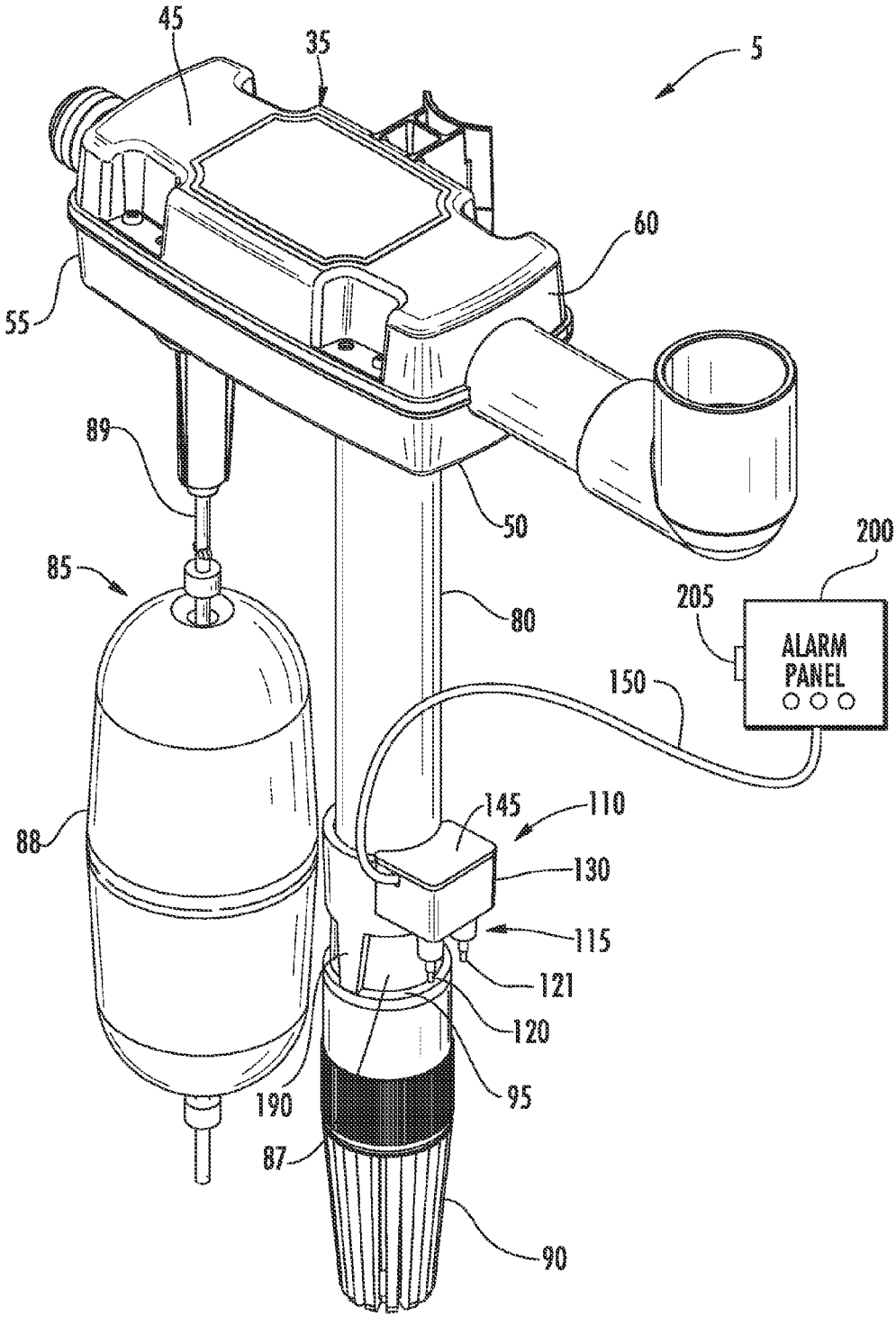
FIG. 2 is a back perspective view of a back-up sump pump with an alarm system.
Figure 3:
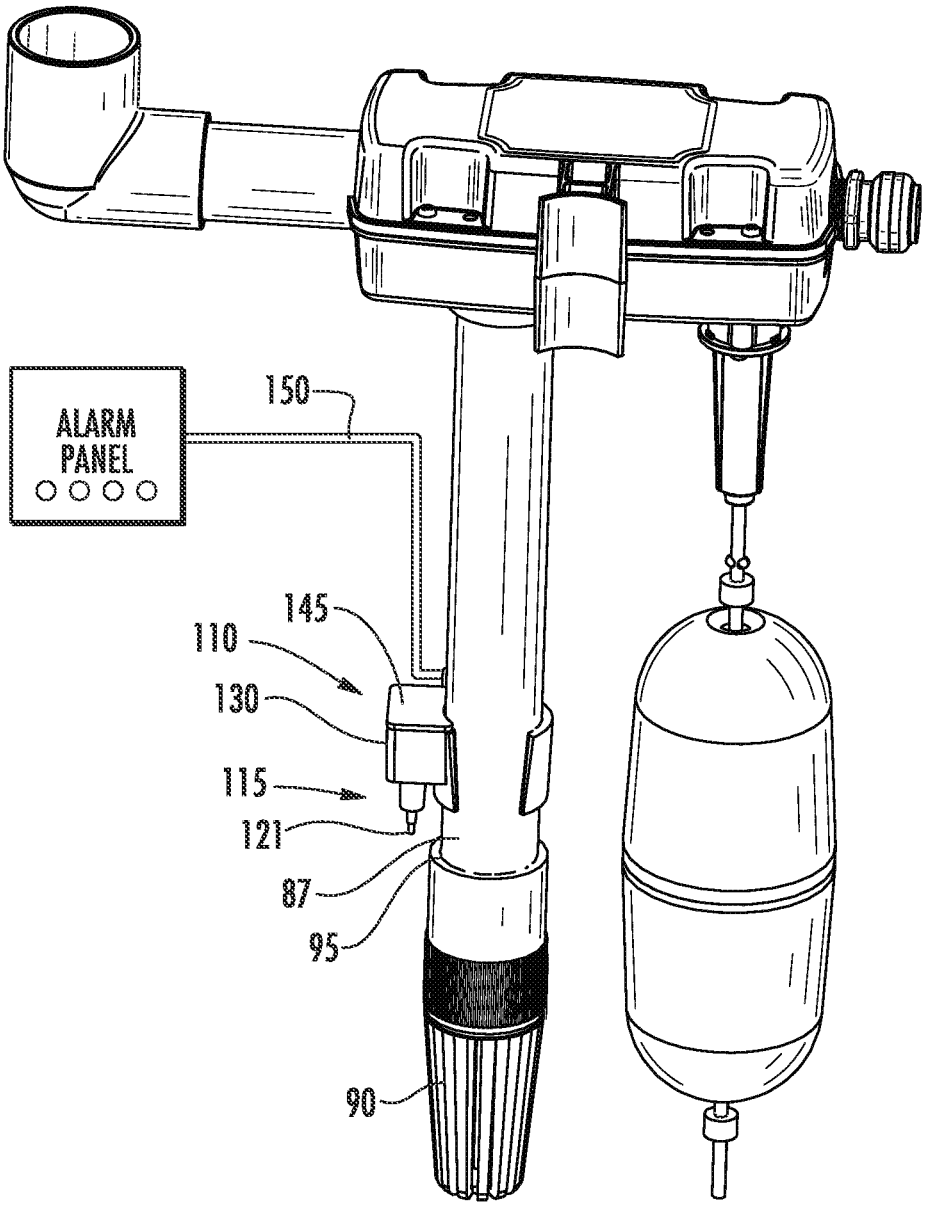
FIG. 3 is a front perspective view of a back-up sump pump with an alarm system.

FIGS. 2 and 3 respectively illustrate a perspective view and a back view of back-up pump assembly 5. A suction pipe 80 extends from bottom end 50 of housing 35 adjacent from water discharge end 60. When pump assembly 5 is in operation, pump 5 draws water through suction pipe 80 and directed toward secondary discharge pipe 78. Suction pipe 80 includes a distal end 87 having a foot valve 90 attached thereto. Distal end 87 of suction pipe 80 is attached to a foot valve 90 having internal components including a removable poppet, spring, and strainer screen (not shown). It should be understood by one skilled in the art that the description of foot valve 90 is exemplary and any suitable configuration for a foot valve may be used. Foot valve 90 eliminates the need for a separate check valve. If freezing discharge pipes are a problem, the strainer screen of foot valve 90 may be unscrewed such that the poppet and spring can be removed and the strainer can be replaced. Foot valve 90 is screwed onto distal end 87 of suction pipe 80 and forms a ledge 95 at the point of connection.

A float switch 85 also extends from bottom end 50 of housing 35 adjacent to water inlet end 55. Float switch 85, which includes a buoyant body 88 connected to a shaft 89, is opened and closed by a float operated magnet, such as a neodymium magnet, to turn pump assembly 5 on when the water level within sump basin 25 reaches a predetermined level. In particular, as buoyant body 88 rises or falls with the water level, it moves a magnetic sleeve into or out of the field of a ferromagnetic plunger. The ferromagnetic material of the plunger is drawn towards the magnetic sleeve, thereby activating the pump by opening the valve to allow water to flow through the venturi. Thus, float switch 85 activates back up sump pump 5 when the water within sump basin 25 reaches a predetermined level. The activation level of pump assembly 5 is the point where the water level causes activation of pump assembly 5.

Figure 4:
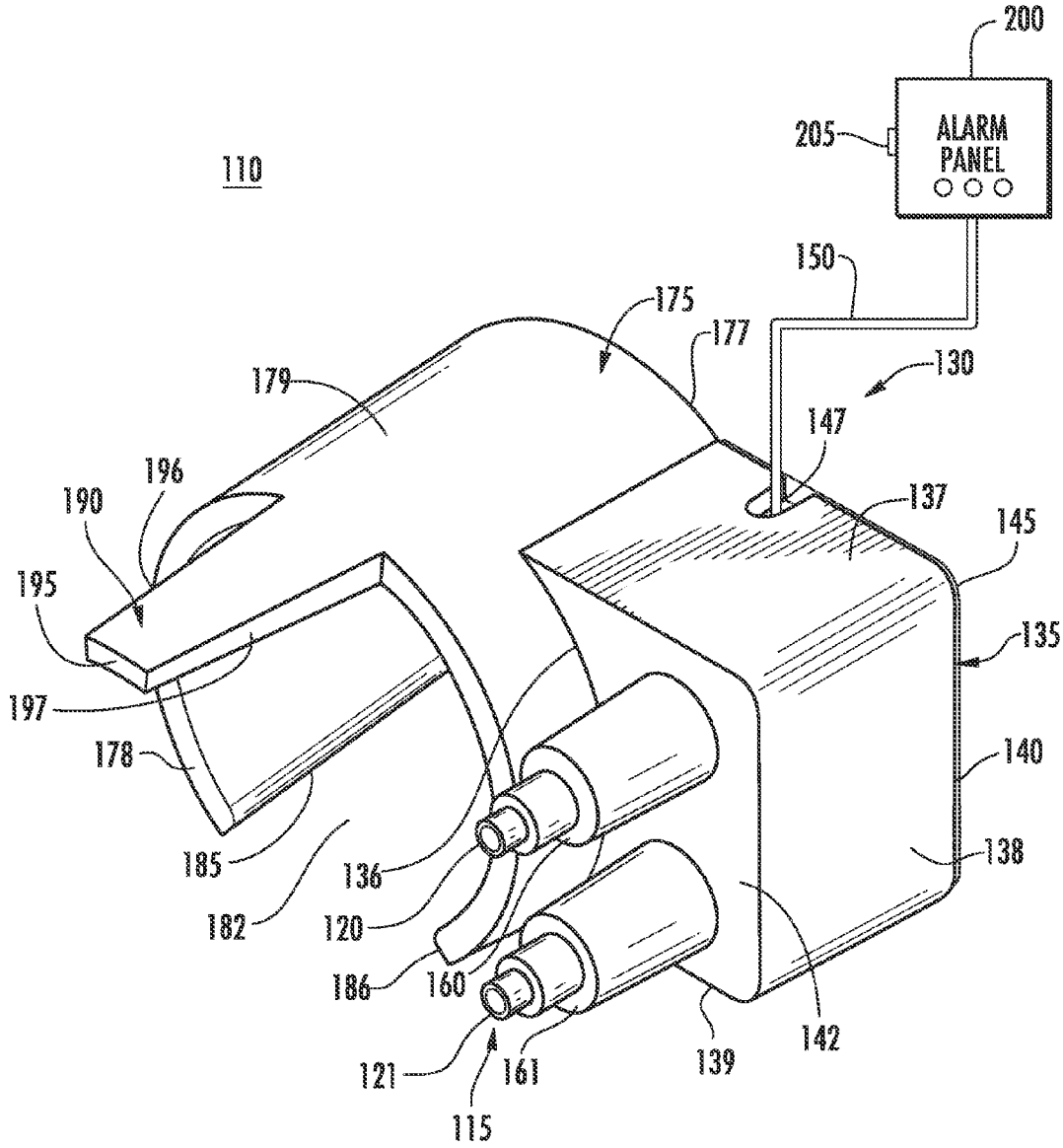
FIG. 4 is a back perspective view of the alarm system of FIG. 3.

An alarm system 110 is also provided on back-up sump pump assembly 5. As shown in FIG. 4, alarm system 110 includes a water sensor 115 for detecting if water within sump basin reaches sensor 115. Since back-up sump assembly is a water-powered sump pump, water sensor 115 notifies a homeowner when water is being used to power water-powered sump pump 5. Water sensor 115 includes two parallel probe sensors 120, 121 that are bridged when the water level reaches sensor 115. More particularly, when the water level in sump basin 25 is below the level of probe sensors 120, 121, they are not immersed and an essentially open circuit exists between probe sensors 120, 121. When probe sensors 120, 121 become immersed in water, a high-conduction electrical path, or bridge, is created between probe 120 and probe 121. Thus, alarm system 110 is activated, as will be described in detail below.

Figure 5:
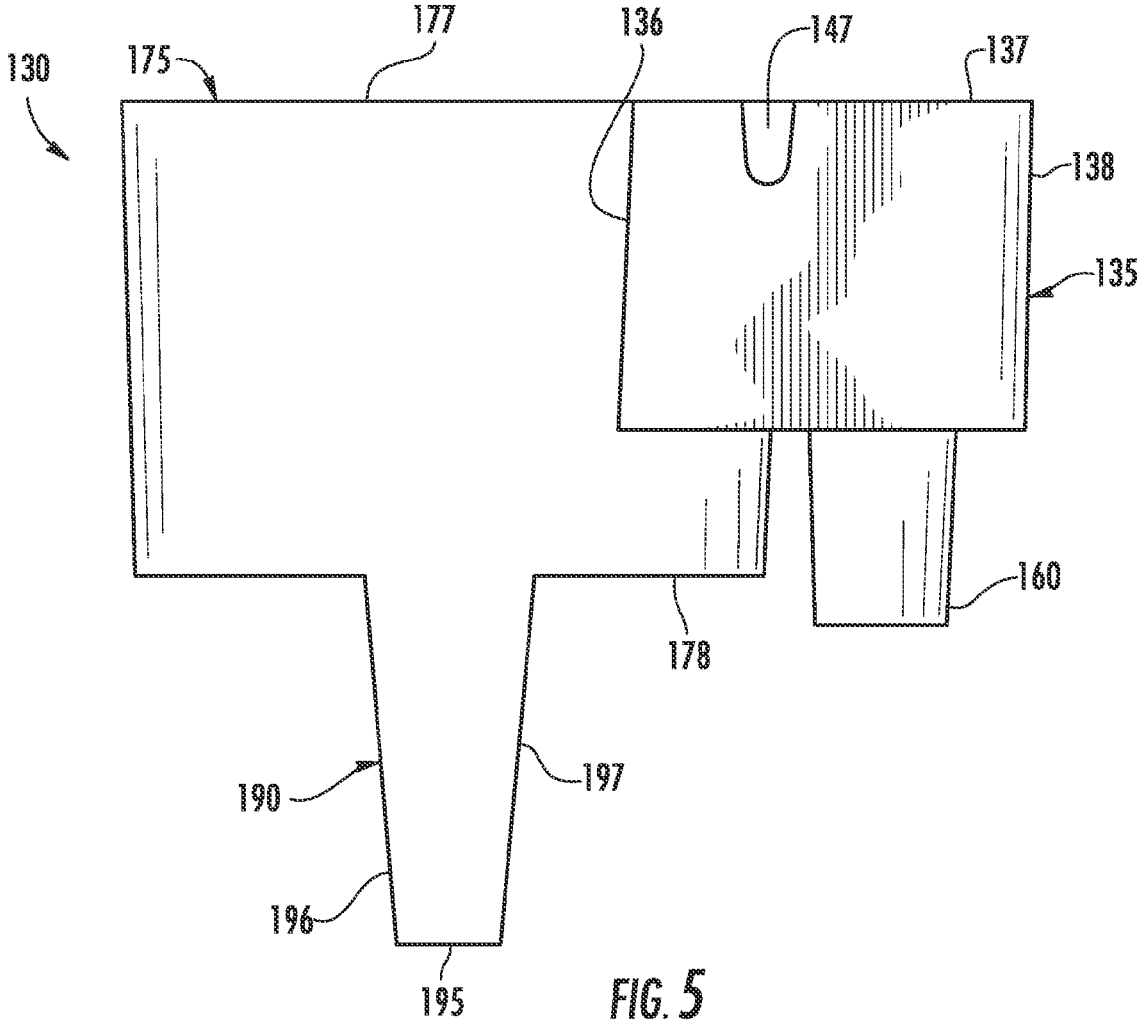
FIG. 5 is a back view of a housing for the alarm system of FIG. 4.
Figure 6:
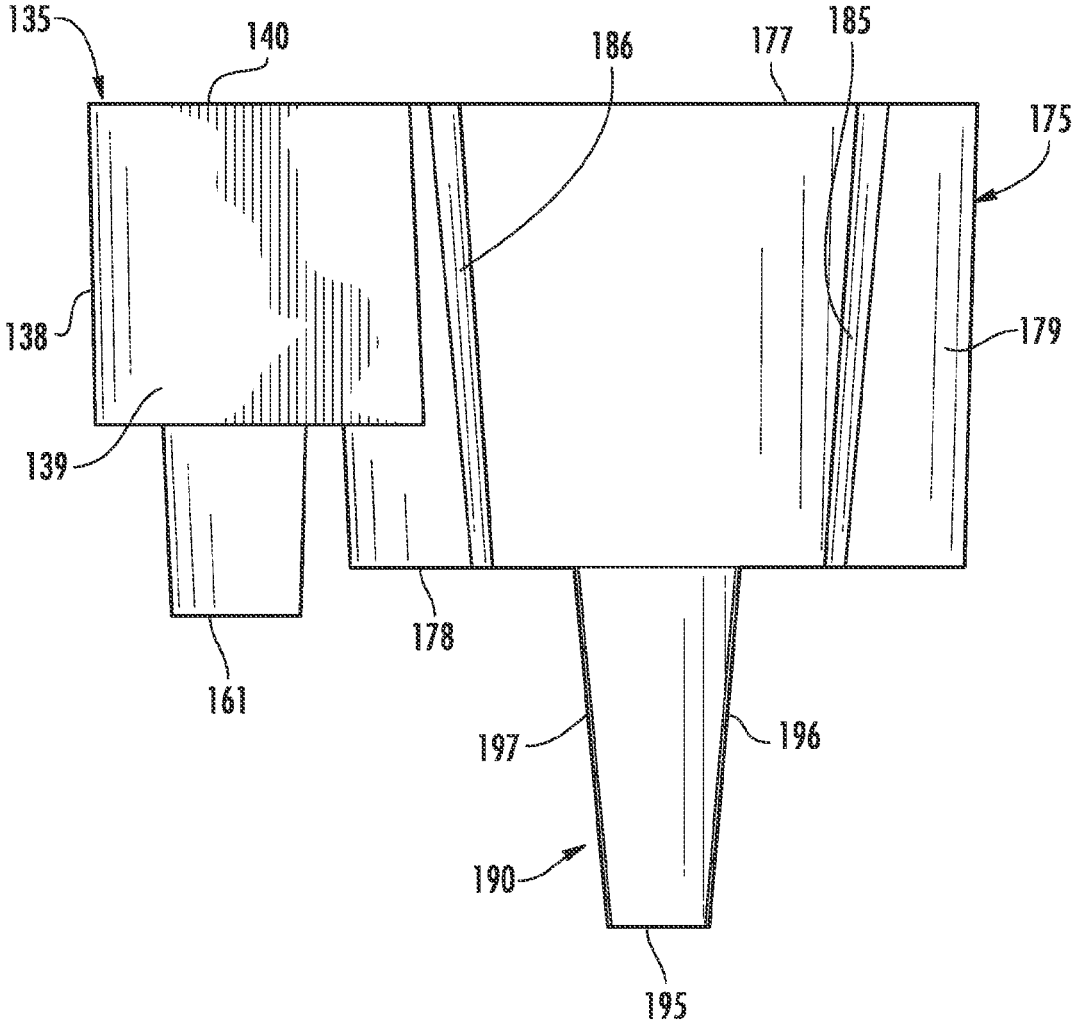
FIG. 6 is a front view of the housing of FIG. 5.

FIGS. 5 and 6 illustrate front and back views of a housing 130 for containing the probe electronics, which are generally known in the art and will not be discussed in detail. Housing 130 allows alarm system 110 to be attached to be easily attached to various pipes for use with various existing sump pump assemblies. Housing 130 is formed with a main enclosure 135 having a first side 136, a second side 137, a third side 138 and a fourth side 139. Housing 130 also includes top end 140 and bottom end 142. Top end 140 is open and includes a cover 145 positioned thereon. Second side 137 has a U-shaped aperture 147 formed therein through which sensor wire 150 extends. Bottom end 142 includes two hollow cylindrical extensions 160, 161 for probe sensors 120, 121 to extend through. First side 136 is generally concave and is adjacent to a clamp 175, which is releasably attachable to suction pipe 80. Clamp 175 may be integrally formed with housing 130. Alternatively, clamp 175 may be attached to housing 130 by fasteners or adhesive.

Clamp 175 includes a sidewall 179, which is an incomplete cylinder that terminates in angled edges 185 and 186, leaving a gap 182 therebetween. Angled edges 185 and 186 with gap 182 therebetween allow clamp 175 to be easily attached to a pipe. Thus, a homeowner can install alarm system 110 to a pump assembly 5 within an existing sump basin 25. Clamp 175 also includes a top edge 177 and a bottom edge 178. Gap 182 in sidewall 179 facilitates the releasable attachment of clamp 175 to suction pipe 80. Further, a locating member 190 is integrally formed with clamp 175 for ensuring that alarm system 110 is positioned on suction pipe 80 of back-up sump pump assembly 5 so that alarm system 110 will be activated just prior to when the water level within sump basin 25 is at a level that activates pump 5. Locating member 190 is a projection that includes a bottom edge 195 and two side edges 196, 197. When in position, bottom edge 195 of locating member 190 abuts ledge 95 of foot valve 90. If alarm system 110 is used with a primary sump pump, a suitable adhesive, such as PVC cement, may be used to further secure clamp 175 to a discharge tube.

Alarm system 110 also includes an alarm panel 200 that is powered by 120 VAC from a standard wall outlet which is transformed to 9VDC. A 9 Volt battery provides battery back-up power so that the alarm will function in the event of a power failure. Alternatively, a DC-only or rechargeable power supply may be used. When water in sump basin 25 is sufficiently high to contact probes 120, 121, the alarm circuit is closed and alarm panel 200 produces an audible alarm and light signal indicating that back up pump 5 has been activated, A rocker switch 205 on a side of alarm panel 200 can be used to silence alarm, which may be a horn. Alarm panel 200 includes a green "power on" light, a "Test" switch, and a red alarm light. A buzzer is also provided to notify a user if the back-up battery needs to be replaced. A set of terminals is provided on the bottom of the alarm panel for connection of the wires 150 from the water sensor 115.

With general reference to FIGS. 1 and 2 the operation of pump assembly 5, including alarm system 110, will now be described in detail. When the water level within sump basin 25 reaches buoyant body 88 of float switch 85, buoyant body 88 rises with the water within of sump basin 25. As buoyant body 88 rises with the water level, it moves a magnetic sleeve into or out of the field of a ferromagnetic plunger. The ferromagnetic material of the plunger is drawn towards the magnetic sleeve, thereby causing the valve to open and activating the pump assembly 5. Sump water is then pumped out of sump basin 25 through foot valve 90 and suction pipe 80. That is, water is drawn through suction pipe 80 into the pump housing 35 where the water is discharged by discharge tube 78 to a point distant from sump basin 25.

Alarm system 110 is activated just prior to the activation of sump assembly 5 and provides an intermittent audible and visual alarm to warn or alert a person within audible distance or visual sight that sump assembly 5 is operational. Housing 130 of alarm system 110 is configured to ensure that probe sensors 120, 121 are positioned to trigger just before pump assembly 5 is activated. Clamp 175 is positioned on suction pipe 80 of pump assembly 5, with bottom edge 195 of locating member 190 of clamp 175 touching ledge 95 of pump's foot valve 90. If the clamp 175 is not positioned directly against the foot valve 90, the alarm may not function properly to notify a homeowner that sump assembly 5 has been activated. For example, if probe sensors 120, 121 are positioned too low the alarm may be activated prematurely and a user may turn the alarm off, thereby making the alarm unavailable should flooding occur subsequently. If probe sensors 120, 121 are positioned too high, pump assembly 5 will be activated and the water level will not rise high enough to activate alarm system 110. Thus, pump assembly 5 may be in operation for an extended period of time without the homeowner's knowledge. Housing 130 may be rotated so that probes 120, 121 face away from float switch 85, thereby minimizing interference from float switch 85. When the water level within sump basin 25 contacts probes 120, 121, a bridge is formed between probes 120, 121 and alarm system 110 is activated. An audible alarm is projected from alarm panel 200. A visual indicator light is also illuminated on alarm panel 200 to alert a person that sump assembly 5 is in use. Alarm panel 200 includes a rocker switch 205 so that the audible alarm may be turned off in case that the sump assembly is being operated as a back-up sump assembly 5 in a power outage.

Figure 7:
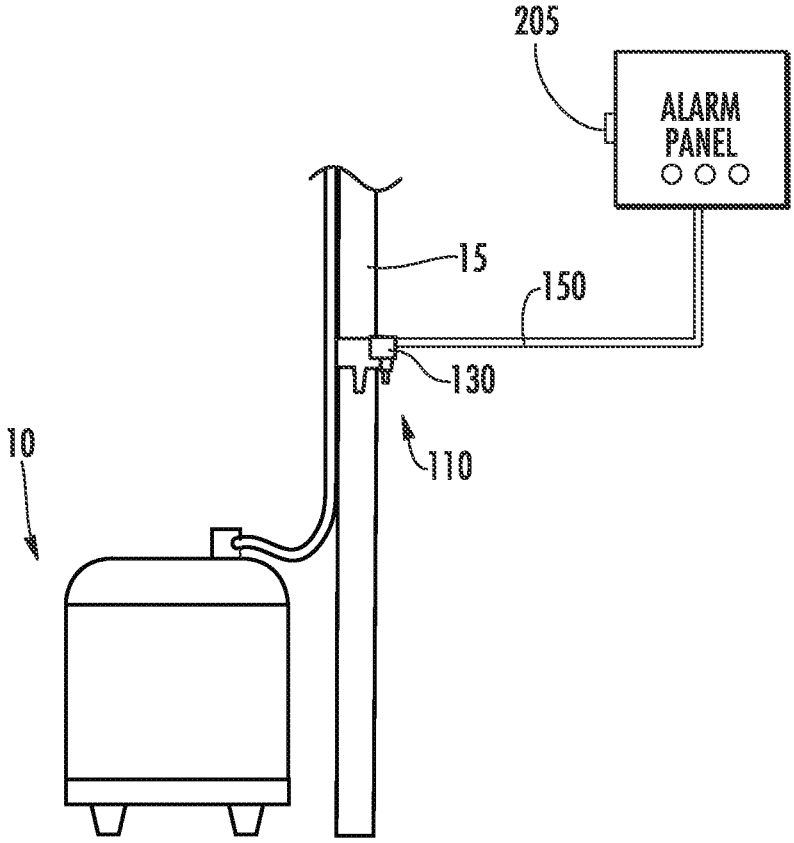
FIG. 7 is a front view of the alarm system on a primary sump pump.

In the embodiment illustrated in FIG. 7, alarm system 110 is used in connection with a primary sump pump 10. Alarm system 110 is connected to discharge pipe 15 by a housing 130, as described above. Alarm system 110 is adapted to connect to a discharge pipe 15 generally having a diameter of between one and one quarter and one and one half inches. An adhesive material, such as PVC cement, may be applied to housing 130 to affix alarm 110 to discharge pipe 15. It should be understood that the alarm system 110 of FIG. 7 includes identical components to the alarm system described above.

Figure 8:
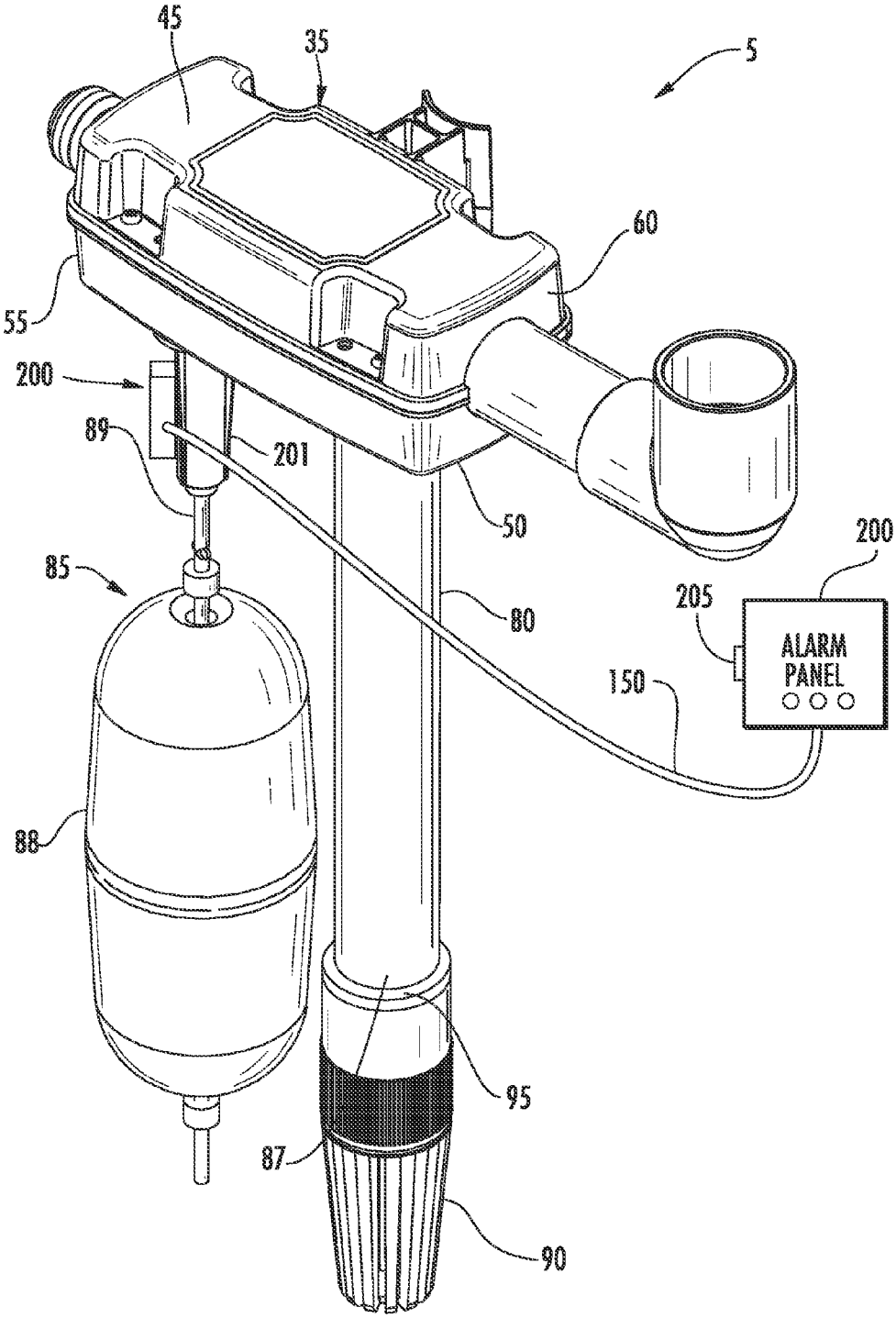
FIG. 8 is a cross sectional view of a sump basin containing a primary sump pump and a back-up sump pump with a second embodiment of an alarm system.

An alternate embodiment of the alarm system 110 is illustrated in FIG. 8. As previously described, float switch 85 extends from bottom end 50 of housing 35 adjacent to water inlet end 55. Float switch 85, which includes a buoyant body 88 connected to a shaft 89, is opened and closed by a float operated neodymium magnet to turn pump assembly 5 on when the water level within sump basin 25 reaches a predetermined level. In particular, as buoyant body 88 rises or falls with the water level, it moves a magnetic sleeve into or out of the field of a ferromagnetic plunger. The ferromagnetic material of the plunger is drawn towards the magnetic sleeve, thereby activating the pump by opening the valve to allow water to flow through the venturi. When the water level within sump basin 25 reaches buoyant body 88 of float switch 85, buoyant body 88 rises with the water within of sump basin 25. As buoyant body 88 rises with the water level, it moves a magnetic sleeve into or out of the field of a ferromagnetic plunger. The ferromagnetic material of the plunger is drawn towards the magnetic sleeve, thereby causing the valve to open and activating the pump assembly 5. Sump water is then pumped out of sump basin 25 through foot valve 90 and suction pipe 80.

In the alternate embodiment illustrated in FIG. 8, the alarm system 110 is triggered when movement of the magnetic sleeve causes a change in the state of a magnetically operated switch 200. A reed switch is one example of magnetically operated switch 200. A reed switch has two contacts, one of which is magnetized. When the reed switch is subjected to a magnetic field, the magnetized contact moves to either complete or break the circuit. When the reed switch is removed from the magnetic field, the contact moves back to its original position, thereby reversing the process. A reed switch can be normally open, meaning that there is normally no continuity in the circuit, but when a magnetic field is applied the switch closes and creates continuity. Likewise, a reed switch could be normally closed, in which case there is normally continuity in the circuit, but when magnetic field is applied the switch opens, thereby breaking continuity. In the embodiment illustrated in FIG. 8, reed switch is positioned in an opening in the shroud 201. As buoyant body 88 rises with the water level in the basin, it moves magnetic sleeve into or out of proximity to the reed switch, which will activate alarm system 110 when the magnetic sleeve is in a position consistent with operation of pump assembly 5.

Alternatively, magnetically operated switch 200 can take the form of a Hall Effect Switch. The Hall Effect switch has no moving parts and depends on detection of the Hall Effect to determine the state (i.e. on or off) of the switch. When a magnetic field is applied perpendicular to an electrical current passing through certain semiconducting materials a corresponding voltage is produced in the perpendicular direction. This is known as the Hall Effect. Switches have been developed around this principle that break the continuity of the circuit when a Hall Effect voltage is detected, thus indicating that the switch is being subjected to a magnetic field. In the embodiment illustrated in FIG. 8, with the magnetically operated switch being a Hall Effect Switch, the Hall Effect Switch is positioned in an opening in the shroud 201. As buoyant body 88 rises with the water level in the basin, it moves magnetic sleeve into or out of proximity to the Hall Effect Switch, which will activate alarm system 110 when the magnetic sleeve is in a position consistent with operation of pump assembly 5.

Figure 9:
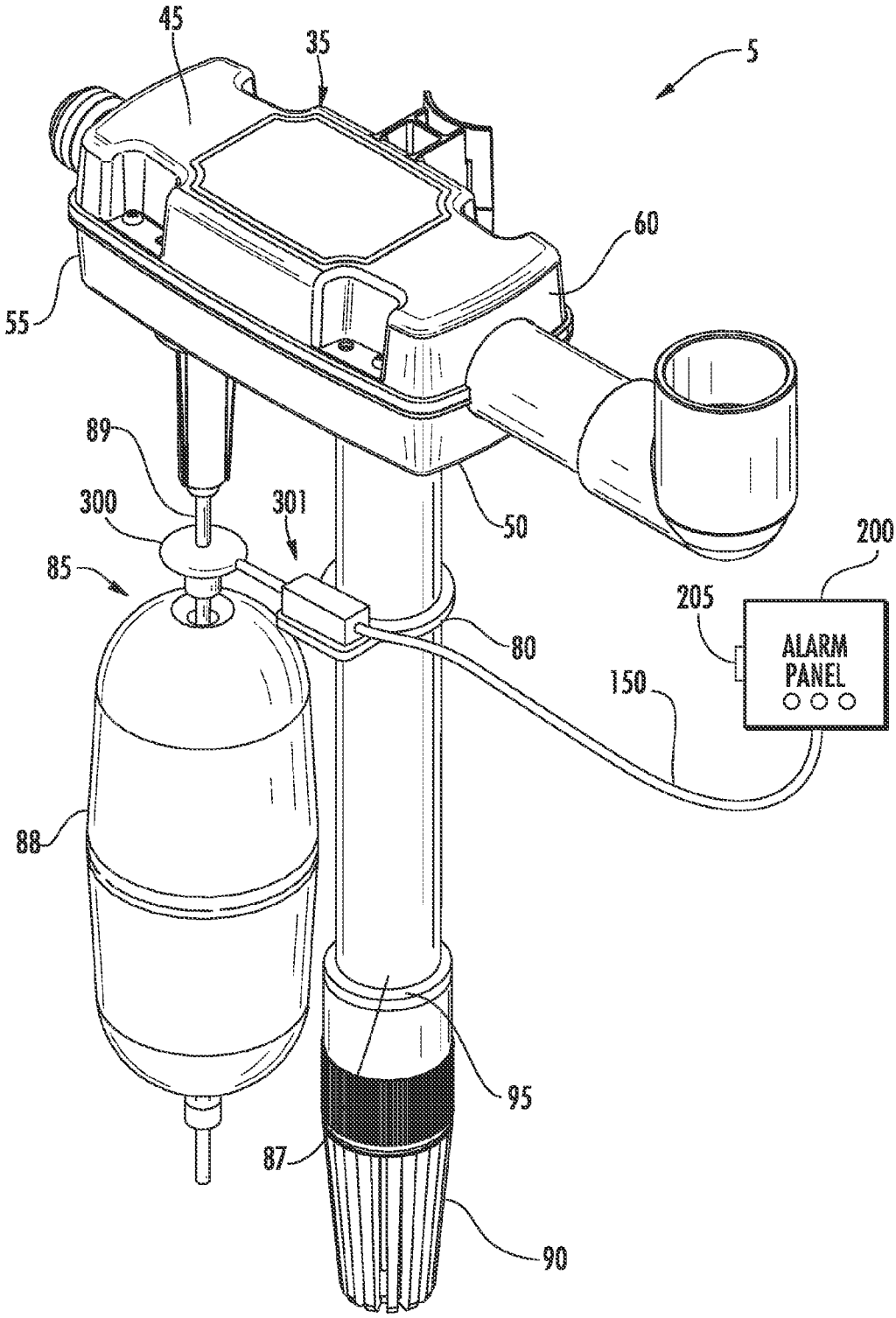
FIG. 9 is a cross sectional view of a sump basin containing a primary sump pump and a back-up sump pump with a third embodiment an alarm system.

Another alternative embodiment of the alarm system 110 is illustrated in FIG. 9. In this embodiment, switch activating member 300 is mounted shaft 89 directly above buoyant body 88. Switch activating member 300 may take the form of a disk or other shape suitable for activating a switch. Micro-switch 301 is provided with a lever portion that activates the switch upon movement of the lever portion. Micro-switch 301 is mounted on suction pipe 80 or other structures sufficiently close to buoyant body 88 and shaft 89 that lever-portion of micro-switch 301 can engage with switch activating member 300. Micro-switch 301 is mounted in such a way that when buoyant body 88 and switch activating member 300 rise with the level of water in the basin to the activation point of pump assembly 5, switch activating member 300 engages lever portion of micro-switch 301, thereby changing the state of micro-switch (i.e. breaking or establishing continuity through micro-switch 301) and activating alarm system 110.

While the alarm system has been described with reference to particular embodiments, it is understood that various modifications can be made to the above described alarm system. For example, alarm system 110 may be adapted to be attached to square, rectangular or other non-cylindrical pipe geometries. Further, alarm system 110 may be used in other areas, such as a swimming pool or other liquid filled enclosures or bodies. For example, alarm system 110 may be attached to a ladder rail in a swimming pool in order to monitor the water level in the swimming pool. Thus, all such modifications of the embodiments are intended to be encompassed as falling within the spirit and scope of the above described embodiments and the appended claims.

We claim:

1. A water-powered sump pump assembly comprising:

a pump for evacuating water from a sump;

a suction pipe operatively attached to said pump, said suction pipe having an inlet end for drawing water out of said sump;

a foot valve positioned on the inlet end of the suction pipe;

an alarm system for generating an alert when said water-powered sump pump is activated and water is being used by said water-powered sump pump, said alarm system comprising:

a water sensor for detecting if water within said sump reaches the sensor;

a housing for containing sensor electronics, said water sensor being supported by said housing;

a clamp extending directly from said housing, said clamp having a top edge and a bottom edge and being releasably attached to said suction pipe such that said alarm system may be positioned to alert a user when water-powered sump pump is activated; and a locating member extending from the bottom edge of the clamp and abutting the foot valve, thereby positioning the water sensor at a predetermined position on the suction pipe.

2. The water-powered sump pump assembly of claim 1 wherein said foot valve includes a ledge and said locating member abuts the ledge of the foot valve.

3. The water-powered sump pump assembly of claim 2, wherein the clamp is an incomplete cylinder that terminates in edges, leaving a gap therebetween, wherein said suction pipe passes through said gap during installation of the alarm system.

4. The water-powered sump pump assembly of claim 1, wherein said water sensor includes two parallel probe sensors that cause activation of said alarm system when water reaches each of the two probe sensors.

5. The water-powered sump pump assembly of claim 3 wherein said predetermined position on said suction pipe is a position where a water level within a sump basin will reach said alarm system prior to reaching an activation level of said sump pump.

6. The water-powered sump pump assembly of claim 1 further comprising an alarm panel.

7. The water-powered sump pump assembly of claim 6 wherein said alarm panel includes an audible signal and light that is activated when a water level reaches the probe sensors.

8. The water-powered sump pump assembly of claim 7 wherein the alarm panel includes a rocker switch for silencing the audible signal.

9. The water-powered sump pump assembly of claim 1 wherein said clamp is an incomplete cylinder that terminates in angled edges, leaving a gap therebetween, wherein said suction pipe passes through said gap during installation of the alarm system.

10. The water-powered sump pump assembly of claim 1 wherein said clamp fits onto said suction pipe having a diameter of between one and one quarter and one and one half inches.

11. An alarm system for generating an alert when a water-powered sump pump is activated and water is being used by said water-powered sump pump, said alarm system comprising:

a water sensor for detecting if water within a sump reaches the sensor;

a housing for containing sensor electronics, said water sensor being supported by said housing; and a clamp extending directly from said housing, said clamp having a top edge and a bottom edge and being releasably attached to a suction pipe such that said alarm system may be positioned to alert a user when said water-powered sump pump is activated, said clamp is an incomplete cylinder that terminates in edges, leaving a gap therebetween, wherein said suction pipe passes through said gap during installation of the alarm system.

12. The alarm system of claim 11 wherein said clamp includes a locating member extending from said bottom edge of said clamp for positioning of said water sensor at a predetermined position on said suction pipe, said locating member adapted to abut a ledge formed on a foot valve of said suction pipe.

13. The alarm system of claim 11, wherein said water sensor includes two parallel probe sensors that cause activation of said alarm system when water reaches each of the two probe sensors.

14. The alarm system of claim 12 wherein said predetermined position on said suction pipe is a position where a water level within a sump basin will reach said alarm system prior to reaching an activation level of said sump pump.

15. The alarm system of claim 13 further comprising an alarm panel.

16. The alarm system of claim 15 wherein said alarm panel includes an audible signal and light that is activated when a water level reaches two parallel probe sensors.

17. The alarm system of claim 16 wherein the alarm panel includes a rocker switch for silencing the audible signal.

18. The alarm system of claim 11 wherein said clamp fits onto said suction pipe having a diameter of between one and one quarter and one and one half inches.

19. A water-powered sump pump assembly comprising:

a pump for evacuating water from a sump;

a suction pipe having an inlet end with a foot valve positioned thereon;

an alarm system for generating an alert when said pump is activated and water is being used by said pump, said alarm system comprising:

a water sensor for detecting if water within said sump reaches the sensor;

a housing for containing sensor electronics, said water sensor extending downwardly from said housing;

a clamp extending directly from said housing, said clamp having a top edge and a bottom edge and being releasably attached to said suction pipe; and a locating member extending from said bottom edge of said clamp for positioning of said water sensor at a predetermined position on said suction pipe, said locating member abutting said foot valve of said suction pipe.

20. The sump pump assembly of claim 19, wherein said water sensor includes two parallel probe sensors that cause activation of said alarm system when water reaches each of the two probe sensors.

21. The sump pump assembly of claim 19 further comprising an alarm panel.

22. The sump pump assembly of claim 19 wherein said predetermined position on said suction pipe is a position where a water level within a sump basin reaches said alarm system prior to reaching an activation level of said sump pump.

23. The sump pump assembly of claim 21 wherein said alarm panel includes an audible signal and light that is activated when the water level reaches the probes.

24. The sump pump assembly of claim 23 wherein the alarm panel includes a rocker switch for silencing the audible signal.

25. The sump pump assembly of claim 19 wherein said clamp is an incomplete cylinder that terminates in angled edges, leaving a gap therebetween, wherein said suction pipe passes through said gap during installation of the alarm system.

26. The sump pump assembly of claim 19 wherein said clamp fits onto said suction pipe having a diameter of between one and one quarter and one and one half inches.

27. The sump pump assembly of claim 19 wherein said clamp is an incomplete cylinder that terminates in edges, leaving a gap therebetween, wherein said suction pipe passes through said gap during installation of the alarm system.

* * * * *